United States Patent [19]

Owen et al.

[11] 4,035,285

[45] July 12, 1977

[54] HYDROCARBON CONVERSION PROCESS

[75] Inventors: Hartley Owen, Belle Mead; Paul B. Venuto, Cherry Hill, both of N.J.

[73] Assignee: Mobil Oil Corporation, New York, N.Y.

[21] Appl. No.: 473,608

[22] Filed: May 28, 1974

[51] Int. Cl.[2] ..... C10G 11/04; C01B 29/28; B01J 8/24

[52] U.S. Cl. ..... 208/120; 208/56; 208/74; 260/668 R

[58] Field of Search ..... 208/120, 111, 56; 260/668

[56] References Cited

U.S. PATENT DOCUMENTS

| | | | |
|---|---|---|---|
| 2,211,944 | 8/1940 | Andrews et al. | 208/121 |
| 2,456,584 | 12/1948 | Gorin et al. | 260/668 |
| 3,533,936 | 10/1970 | Weisz | 208/56 |
| 3,617,496 | 11/1971 | Bryson et al. | 208/80 |
| 3,650,946 | 3/1972 | Mourning | 208/120 |
| 3,728,408 | 4/1973 | Tobias | 260/668 |
| 3,743,593 | 7/1973 | Saxton | 208/55 |
| 3,758,402 | 9/1973 | Oleck et al. | 208/111 |
| 3,758,403 | 9/1973 | Rosinski et al. | 208/120 |
| 3,803,028 | 4/1974 | Mead et al. | 208/111 |
| 3,812,199 | 5/1974 | Chen et al. | 260/676 |
| 3,849,291 | 11/1974 | Owen | 208/78 |
| 3,894,107 | 7/1975 | Butter et al. | 260/668 R |
| 3,904,508 | 9/1975 | Whyte et al. | 208/17 |
| 3,907,915 | 9/1975 | Chang | 260/668 R |

*Primary Examiner*—Delbert E. Gantz
*Assistant Examiner*—G. E. Schmitkons
*Attorney, Agent, or Firm*—Charles A. Huggett; Carl D. Farnsworth

[57] ABSTRACT

An operation is described which involves the catalytic cracking of high boiling hydrocarbons in the presence of hydrogen and carbon-hydrogen contributing fragments in the presence of particularly crystalline zeolite conversion catalysts promoting the chemical reactions of cracking, hydrogen redistribution, olefin cyclization and chemical reactions providing mobile hydrogen in one of several different forms and suitable for completing desired hydrogen transfer reactions. The chemical reactions desired are particularly promoted by a mixture of large and smaller pore crystalline zeolites in the presence of hydrogen contributing materials such as methanol or mixed with one or more reactants which will form methanol under suitable reaction conditions.

14 Claims, No Drawings

HYDROCARBON CONVERSION PROCESS

BACKGROUND OF THE INVENTION

It is known in the prior art to upgrade hydrogen deficient petroleum oils to more valuable products by thermal and catalytic cracking operations in admixture with a hydrogen donor diluent material. The hydrogen donor diluent is a material, aromatic-naphthenic in nature that has the ability to take up hydrogen in a hydrogenation zone and to readily release hydrogen to a hydrogen deficient oil in a thermal or catalytic cracking operation.

One advantage of a hydrogen donor diluent operation is that it can be relied upon to convert heavy oils or hydrogen deficient oils at relatively high conversions in the presence of catalytic agents with reduced coke formation. Coke as formed during the cracking operation is usually a hydrocarbonaceous material sometimes referred to as a polymer of highly condensed, hydrogen poor hydrocarbons.

Catalytic cracking systems in use today have taken advantage of new catalyst developments, that is, the use of crystalline zeolite cracking catalysts in preference to the earlier used amorphous silica-alumina cracking catalyst. These new crystalline zeolite cracking catalysts are generally regarded as low coke producing catalysts and have also been found to exercise greater hydrogen transfer activity than the known amorphous silica-alumina cracking catalyst. Thus as the level of coke deposits has been reduced through the use of the crystalline zeolite it has been equally important to concentrate in recovering the maximum amount of heat available through the burning of deposited coke. However, when operating a catalytic cracking process within optimum conditions provided by the crystalline zeolite conversion catalysts, the petroleum refiner is still faced with operating a hydrogen deficient process which does not permit the most optimistic recovery of desired products.

The present invention is converned with an improved hydrocarbon conversion operation designed to particularly reduce the hydrogen deficiency as well as the coke forming tendencies of the catalytic cracking operation.

SUMMARY OF THE INVENTION

The present invention is concerned with providing mobile hydrogen alone or combined with carbon in molecular fragments in a crystalline zeolite hydrocarbon conversion operation in such amounts that the yield of desired hydrocarbon product will be simultaneously increased. In a more particular aspect the present invention is concerned with providing hydrogen contributing materials and/or carbon-hydrogen molecular fragments to a catalytic cracking operation which are lower boiling than a high molecular weight hydrocarbon charged to the cracking operation. In yet another aspect the present invention is concerned with providing the hydrocarbon conversion operation with one or more crystalline zeolite catalytic materials which will promote chemical reactions with mobile hydrogen and/or carbon-hydrogen molecular fragments in addition to promoting catalytic cracking reaction to provide useful products contributing to gasoline boiling range material.

In the present invention a "low molecular weight carbon-hydrogen contributing material" and a "high molecular weight feedstock" are intimately mixed with one another and reacted with a crystalline zeolite catalyst comprising an acid function, wherein cracking and additive carbon-hydrogen reactions occur to produce products of improved quality and superior to those formed in the absence of the low molecular weight carbon-hydrogen contributing material. The cracking and additive reactions occur in the presence of a crystalline zeolite catalyst with hydrogen-transfer activity during exposure at an elevated temperature to a mixture of the low molecular weight carbon-hydrogen material and the high molecular weight feedstock.

A particular advantage of the reaction concepts of this invention is that they occur at low pressures (i.e. at pressures commonly employed in current catalytic cracking operations or slightly higher). It is most preferred that the reactions be performed in fluidized beds (risers, dense beds, etc.), but they can also be practiced in some fixed bed arrangements or moving bed catalytic systems. The reactions described herein may occur in one stage of operation all at the same process conditions, or in a sequence of two or more stages of operation, at the same or different process conditions. Further, the catalyst functions referred to herein may be on the same catalyst particle, or on different catalyst particles such as a mixture of crystalline zeolite catalytic materials.

Some specific advantages derivable from the improved process concept of this invention include improved crackability of heavy feedstocks, increased gasoline yield and/or gasoline quality (including octane and volatility), and fuel oil fractions of improved yield and/or burning quality and lower levels of potentially polluting impurities such as sulfur and nitrogen. The need for costly high pressure hydrotreaters and hydrocrackers using expensive molecular hydrogen rich gas can thus be eliminated, or the severity requirements of the operation greatly decreased, thus saving considerably capital investment and operating costs.

By low molecular weight carbon-hydrogen contributing material is meant materials comprising a lesser number of carbon atoms than found in materials within the gasoline boiling range and preferably those materials containing 5 or less carbon atoms that fit into any of the categories of:

a. Hydrogen-rich molecules, i.e. molecules with wt. % H ranging from about 13.0–25.0 wt. %. This may include light paraffins, i.e. $CH_4$, $C_2H_6$, $C_3H_8$ and other materials.

b. A hydrogen donor molecule, i.e. a molecule whose chemical structure permits or favors intermolecular hydrogen transfer. This includes $CH_3OH$, other low boiling alcohols such as ethanol, n-propanol, isopropanol, n-butanol, isobutanol, etc., aliphatic ethers, other oxygen compounds (acetals, aldehydes, ketones) certain sulfur, nitrogen and halogenated compounds. These would include $C_2$–$C_5$ aliphatic mercaptans, disulfides, thioethers, primary, secondary, tertiary amines and alkylammonium compounds, and haloalkanes such as methyl chloride etc.

c. Reactants that chemically combine to generate hydrogen donors or active or nascent hydrogen, i.e. carbon monoxide, CO, especially CO + $H_2O$, CO + $H_2$, CO + alcohol, CO + olefin, etc.

d. Secondary Reaction Products from materials in categories (a), (b), or (c) above that are hydrogen donors themselves, or transfer hydrogen, or become involved in intermolecular hydrogen transfer in which hydrogen redistribution occurs. This includes olefins, naphthenes, or paraffins.

e. Classes of materials which are structurally or chemically equivalent to those of category (d), notably olefins, etc.

f. A combination of any or all of the materials in categories (a) through (e).

g. A preferred low molecular weight material is methanol.

By high molecular weight feedstock is meant any material that boils higher than a conventional gasoline end boiling point, i.e. about 11–12 C-number or higher. It is especially preferred that high molecular weight feedstocks include catalytic cracking feeds or potential feeds therefor such as distillate gas oils, heavy vacuum gas oils, atmospheric resids, syncrudes (from shale oil, tar sands, coal), pulverized coal and combinations thereof.

By catalyst with a cracking or acid function is meant an acidic composition, most preferably a solid, such as a commercial amorphous or zeolitic cracking catalyst and combinations thereof. A preferred composition includes a crystalline zeolite component (or components) intimately dispersed in a matrix.

By catalyst with a hydrogen-activating function is meant one of several classes of catalysts which aid in the redistribution or transfer of hydrogen, or which are classified as hydrogen dissociation, hydrogen activation, or hydrogenation catalysts. The catalyst with a hydrogen-activating function may or may not contain a metal function. Some of the preferred metal functions are Pt, Ni, Fe, Co, Cr, Th, (or other metal function capable of catalyzing the Fischer-Tropsch or water-gas shift reaction), or Re, W, Mo or other metal function capable of catalyzing olefin disproportionation.

The term hydrogen transfer is known in the art of catalytic conversion to characterize the ability to transfer hydrogen other than molecular hydrogen from one type of hydrocarbon to another with a catalyst particularly promoting the transfer. This type of chemical reaction is to be contrasted with hydrogenation catalysts or catalyst components capable of attaching hydrogen to an olefin from gaseous molecular hydrogen.

A group of highly active catalyst particularly suitable for use in the practice of the present invention are zeolitic crystalline aluminosilicates of either natural or synthetic origin having an ordered crystal structure. These crystalline zeolite materials are possessed with a high surface area per gram and are microporous. The ordered structure gives rise to a definite pore size of several different forms. For example, the crystalline zeolite may comprise one having an average pore size of about 5A such as Linde 5A or chabasite or it may be an erionite or an offretite type of crystalline zeolite. A crystalline zeolite with a pore size in the range of 8–15-A pore size such as a crystalline zeolite of the X or Y faujasite type of crystalline material may be used. Mordenite and ZSM-5 type of crystalline aluminosilicates may also be employed. In the process of the present invention it is preferred to use crystalline zeolites having a pore size sufficiently large to afford entry and egress of desired reactant molecules. Thus, the catalyst may be a large pore crystalline zeolite such as an X or Y faujasite variety or it may be a mixture of large and smaller pore crystalline zeolites. In this regard the mixed crystalline aluminosilicates used in the method of this invention will provide a pore size spread greater than 4 and less than 15 Angstrom units. The small pore zeolite portion of the catalyst may be provided by erionite, offretite, mordenite and ZSM-5 type of crystalline zeolite. Methods of preparing these various crystalline zeolites are the subject of numerous patents now available.

The aluminosilicate active components of the catalyst composite may be varied within relatively wide limits as to the crystalline aluminosilicate employed, cation character, concentration as well as in any added component by precipitation, adsorption and the like. Particularly, important variables of the zeolites employed include the silica-alumina ratio, pore diameter and spatial arrangement of cations.

The crystalline aluminosilicate or crystalline zeolites suitable for use in the present invention may be modified in activity by dilution with a matrix material of significant or little catalytic activity. It may be one providing a synergistic effect as by large molecule cracking, large pore material and act as a coke sink. Catalytically active inorganic oxide matrix material is particularly desired because of its porosity, attrition resistance and stability under the cracking reaction conditions encountered particularly in a fluid catalyst cracking operation. Inorganic oxide gels suitable for this purpose are fully disclosed in U.S. Pat. No. 3,140,253 issued July 7, 1964 and such disclosure is incorporated herein by reference.

The catalytically active inorganic oxide may be combined with a raw or natural clay, a calcined clay, or a clay which has been chemically treated with an acid or an alkali medium or both. The catalyst may also be provided with an amount of iron and/or nickel which materials are known to promote the Fischer-Tropsch reaction. The matrix material is combined with the crystalline aluminosilicate in such proportions that the resulting product contains a minor proportion of up to about 25% by weight of the alumino-silicate material and preferably from about 1% up to about 25 weight percent thereof may be employed in the final composite.

The mobile hydrogen component of the reaction mixture of the present invention may be provided from several different sources, such as the high molecular weight feed and the low molecular weight material, it being preferred to obtain hydrogen moieties from gasiform and vaporous component materials occurring in the operation lower boiling than the hydrocarbon material charged to the cracking operation. Thus, it is proposed to obtain the hydrogen moieties suitable for hydrogen distribution reactions from component and component mixtures selected from the group comprising methanol, dimethylether, CO and water, carbon monoxide and hydrogen, $CH_3SH$, $CH_3NH_2$, $(CH_3)_2NH$, $(CH_3)_3N$, $(CH_3)_4N$ and $CH_3X$, where X is a halide such as fluorine, bromine, chlorine and iodine. Of these hydrogen contributing materials it is preferred to use methanol alone or in combination with either CO alone, or CO and water together. On the other hand, it is contemplated combining light olefinic gaseous products found in pyrolysis gas and the products of catalytic cracking such as ethylene, propylene and butylene with the hydrogen contributing material and/or carbon hydrogen contributing material. In any of these combinations, it is preferred that the mobile hydrogen or the carbon-hydrogen fraction be the product of one or more chemical reactions particularly promoted by a relatively small pore crystalline zeolite such as a ZSM-5 type of crystalline zeolite or a small pore mordenite type zeolite. Methanol is a readily available commodity obtained from CO and $H_2$ synthesis, coal gasification, natural gas conversion, and other known sources.

The hydrocarbon feeds which may be processed in the cracking operation of this invention may be any heavy petroleum fraction such as atmospheric gas oil, vacuum gas oils, atmospheric and vacuum resids, synthetic crudes derived from oil shale, tar sands, coal and solvent refined coal. In short, any hydrogen deficient feedstock and preferably one that would require a more conventional high pressure hydrocracking and hydrotreating operation to render the feed suitable for use in a fluid catalytic cracking operation can be used in the method of this invention.

Current practice for upgrading high molecular weight, hydrogen-deficient, high-impurity refinery stocks generally involves either hydrotreating followed by catalytic cracking, or hydrocracking, both of which involve the use of costly gaseous hydrogen at high pressure (i.e. 500–3000 psig), in expensive, high-pressure process units. Alternately some poor quality stocks are catalytically cracked alone with low quality product being produced which requires extensive upgrading or dilution before becoming saleable. Some of these processes often require expensive gas compressors and complex heat transfer or hydrogen-quenching systems. In addition, although these processes improve conversion and product yields, significant losses in gasoline octane are often incurred, requiring a subsequent reforming step to upgrade gasoline quality.

The current concept employs a fluidized catalyst system at low pressures without the need for high pressure hydrogen gas. Such a system promotes the highly efficient contact of relatively inexpensive hydrogen contributing low molecular weight materials with heavy, refractory molecules in the presence of high-surface area cracking catalyst with or without hydrogen-activating catalyst functions. Intermolecular hydrogen-transfer interactions and catalytic cracking reactions effected in the presence of fluidized catalyst particles minimize problems due to diffusion/mass transport limitations and/or heat transfer.

The concepts of the present invention make use of relatively cheap, low molecular weight hydrogen contributors readily available in petroleum refineries, such as light gas fractions, light olefins, low boiling liquid streams, etc. It also makes particular use of methanol, a product which is readily available in quantity, either as a transportable product from overseas natural gas conversion processes, or as a product from large scale coal, shale, or tar sand gasification. It also can utilize carbon monoxide (in combination with hydrogen contributors such as water or methanol), which gas is readily available from refinery regeneration flue gas (or other incomplete combustion processes), or from coal, shale, or tar sand gasification. Highly efficient recycle of unused hydrogen contributors can also be effected.

A particularly attractive feature of this invention is concerned with converting whole crude hydrocarbon materials. That is, a whole crude may be utilized as the charge with the light end portion thereof constituting a part of the low molecular weight hydrogen contributor alone or in combination with added methanol or other hydrogen contributing light materials and the heavier end portion of the whole crude constituting the high molecular weight feedstock.

It is anticipated that as a result of the processing concepts herein defined, requirements for reforming and alkylation can be greatly reduced, thus saving the petroleum refiner investment and operating cost.

The combination reactions comprising this invention are effective in removing sulfur, oxygen, nitrogen and metal contaminants found in a whole crude or a heavy hydrocarbon portion thereof.

The chemical-conversion operation of this invention is accomplished at temperatures within the range of 400° F. up to about 1200° F. and more usually within the range of 700° F. to about 1100° F. at pressures selected from within the range of below atmospheric up to several hundred pounds but normally less than 100 psig. Preferred conditions include a temperature within the range of about 800° F. to about 1000° F. and pressures within the range of atmospheric to about 100 psig.

In an operation embodying the concepts of this invention using methanol in combination with a gas oil type of hydrocarbon charge stock, a ratio of methanol to hydrocarbon charge passed to the cracking or conversion operation will vary considerably and may be selected from within the range of from about 0.01 to about 5, it being preferred to maintain the ratio within the range of about 0.05 to about 0.30 on a stoichiometric weight basis. However, this may vary depending upon the hydrogen deficiency of the high molecular weight hydrocarbon charge, the amount of sulfur, nitrogen and oxygen in the oil charge, the amount of polycyclic aromatics, the type of catalyst employed, and the level of conversion desired. It is preferred to avoid providing any considerable or significant excess of methanol with the charge because of its tendency to react with itself under some conditions.

In a specific embodiment, this invention includes the catalytic cracking of high boiling residual hydrocarbons in the presence of hydrogen and carbon-hydrogen contributing materials in the presence of crystalline zeolite conversion catalysts particularly performing the chemical reactions of cracking, hydrogen redistribution, olefin cyclization and chemical reaction providing mobile hydrogen in one of several different forms and suitable for completing desired hydrogen transfer reactions. The chemical reactions desired are particularly promoted by a mixture of large and small pore crystalline zeolites in the presence of hydrogen donor materials such as methanol or a mixture of reactants which will form methanol under, for example, Fischer-Tropsch, or other processing conditions. The conditions of cracking may be narrowly confined within the range of 900° F. to 1100° F. at a hydrocarbon residence time within the range of 0.5 second to about 5 minutes. The catalyst employed is selected from a rare earth exchanged X or Y faujasite type crystalline zeolite material, a Mordenite or ZSM-5 type crystalline zeolite either component of which is employed alone in an amount within the range of 2 weight percent up to about 15 weight percent dispersed in a suitable matrix material. The faujasite and mordenite crystalline zeolites may be employed alone or in admixture with a ZSM-5 type of crystalline zeolite supported by the same matrix or by a separate silica-clay matrix containing material.

DISCUSSION OF SPECIFIC EMBODIMENTS

Example 1

A heavy vacuum gas oil (HVGO) was used as the hydrocarbon feed in the cracking operations of the following examples and provided the following inspections: API gravity (60° F) 20.3; refractive index, 1.5050; average molecular weight 404; weight percent hydrogen, 11.81; weight percent sulfur, 2.69; weight percent total nitrogen, 0.096; basic nitrogen (p.p.m.), 284; metals; less than 2 p.p.m.; boiling range, 748° F. (10%) – 950° F.(90%). The methanol used with the hydrocarbon feed in comparative runs was C.P. grade methanol.

In run B of Table I presented below, a mixture of methanol (16.5 weight percent based on HVGO) and (HVGO) heavy vacuum gas oil identified above were pumped from separate reservoirs to the inlet of a feed preheater of a 30 ft. bench scale riser FCC unit. The feed materials were intimately mixed in the feed preheater at 790° F. and then admitted to the riser inlet, where the hot (1236° F) equilibrium catalyst (15 wt.% REY) (67.5 FAI) fluid activity index) was admitted and catalytic reaction allowed to occur. The catalyst Fluid Activity Index (FAI) is defined as the conversion obtained to provide a 356° F. 90% ASTM gasoline product processing a Light East Texas Gas Oil (LETGO) at a 2 c/o, 850° F. 6 WHSV for 5 minutes on stream time. Conversion is defined as 100-cycle oil product. The riser reactor inlet and mix temperature were 1000° F., ratio of catalyst to oil (Oil = HVGO + $CH_3OH$) by weight was 4.07, catalyst residence time was 4.8 sec., riser inlet pressure was 30 psig, and ratio of catalyst residence time to oil residence time (slip) was 1.26. The riser effluent was passed through a steam stripping chamber, and the gaseous effluent was separated from spent catalyst (1.02 weight percent carbon). The gaseous and liquid products were collected and separated by distillation and analyzed. Data for the operating conditions and mass balance are shown in Table I below.

TABLE I-A

HEAVY VACUUM GAS OIL WITH/WITHOUT METHANOL REACTION CONDITIONS AND MASS BALANCE 15% REY CATALYST

| | Run A | Run B |
|---|---|---|
| OPERATING CONDITIONS | | |
| Reactor Inlet Temp., ° F. | 1000 | 1000 |
| Oil Temp., ° F. | 790 | 790 |
| Catalyst Inlet Temp., ° F. | 1236 | 1237 |
| Catalyst/oil (Wt/Wt) Ratio[b] | 3.96 | 4.07 |
| Catalyst Residence Time, Sec. | 4.87 | 4.80 |
| Reactor Pressure, Inlet, psig | 30 | 30 |
| Carbon, Spent Catalyst, % Wt. | .963 | 1.022 |
| Sulfur, Spent Catalyst, % Wt. | .0173 | .0204 |
| Slip Ratio | 1.27 | 1.26 |
| Catalyst | ← 15% REY FAI 67.5, burned white → | |
| YIELDS (NLB ON TOTAL FEED) | | |
| Conversion, % Vol.[a] | 65.23 | 63.20 |
| $C_5$+ Gasoline, % Vol. | 53.53 | 50.06 |
| Total $C_4$, % Vol. | 13.03 | 9.90 |
| Dry Gas, % Wt. | 7.36 | 9.92 |
| Coke, % Wt. | 4.11 | 4.82 |
| Gaso. Efficiency, % Vol. | 82.06 | 79.2 |
| Gasoline R+O, Raw Octane | 87.8 | 89.5 |
| $H_2$ Factor | 27 | 15 |

TABLE I-A-continued

HEAVY VACUUM GAS OIL WITH/WITHOUT METHANOL REACTION CONDITIONS AND MASS BALANCE 15% REY CATALYST

| | Run A | Run B |
|---|---|---|
| Recovery, % Wt. | 96.83 | 102.49[c] |
| Wt.% $CH_3OH$, % of Heavy Vacuum Gas Oil | — | 16.5 |
| Molar ratio, $CH_3OH$/HVGO | — | ~2.1 |
| Detailed Mass Balance[d] | | |
| $H_2S$, % Wt. | .58 | .10 |
| $H_2$, % Wt. | .05 | .08 |
| $C_1$, % Wt. | .89 | 3.83 |
| $C_2$=, % Wt. | .56 | .84 |
| $C_2$, % Wt. | .75 | .92 |
| $C_3$=, % Vol. | 6.26 | 5.75 |
| $C_3$, % Vol. | 1.86 | 1.67 |
| $C_4$=, % Vol. | 7.28 | 6.67 |
| i- $C_4$, % Vol. | 4.65 | 2.53 |
| n- $C_4$, % Vol. | 1.10 | 0.71 |
| $C_5$=, % Vol. | 5.54 | 5.33 |
| i- $C_5$, % Vol. | 4.36 | 2.29 |
| n- $C_5$, % Vol. | 0.89 | 0.58 |
| $C_5$+ Gaso., % Vol. | 53.53 | 50.06 |
| Cycle Oil, % Vol. | 34.77 | 36.85 |
| Coke, % Wt. | 4.11 | 4.82 |

[a]356° F. at 90% cut point
[b]On $CH_3OH$ + HVGO
[c]Includes added mass from $CH_3OH$ reaction.
[d]Selectivities are based on total products arising from methanol + HVGO reaction

TABLE I-B

GASOLINE INSPECTIONS

| | Run A | Run B |
|---|---|---|
| Sp. Grav., 60° F. | .7495 | .7491 |
| API Grav., 60° | 57.3 | 57.4 |
| Alkylates % Vol. | 22.63 | 18.18 |
| $C_5$+ Gasoline + alkylate, % Vol. | 76.16 | 59.29 |
| Outside i-$C_4$ required, % Vol. | 10.65 | 10.04 |
| R+O Octane No., Raw | 87.8 | 89.5 |
| Hydrocarbon Types $C_5$- Free, vol.% | | |
| Paraffins | 33.1 | 18.9 |
| Olefins | 24.1 | 43.6 |
| Naphthenes | 12.1 | 7.2 |
| Aromatics | 30.2 | 30.2 |
| Distillation, ° F. | | |
| 10% | 79 | 94 |
| 50% | 222 | 233 |
| 90% | 349 | 363 |

TABLE I-C

CYCLE OIL INSPECTIONS

| | Run A | Run B |
|---|---|---|
| Sp. Grav., 60° F. | .9984 | .9746 |
| API Grav., 60° F. | 10.23 | 13.69 |
| Sulfur, % Wt. | 4.45 | 4.24 |
| Hydrogen, % Wt. | 8.21 | 9.18 |
| Hydrocarbon Type, Wt.% | | |
| Paraffins | 7.3 | 8.8 |
| Mono-naphthenes | 2.3 | 2.5 |
| Poly-naphthenes | 4.4 | 5.9 |
| Aromatics | 86.1 | 82.8 |
| Naphthene/Aromatic/wt/wt/ratio | .078 | 0.10 |
| Distillation, ° F. | | |
| 10% | 470 | 429 |
| 50% | 695 | 540 |
| 90% | 901 | 794 |

TABLE I-C-continued

| CYCLE OIL INSPECTIONS | Run A | Run B |
|---|---|---|
| Aromatic Breakdown, Normalized, Wt.-% | | |
| Mono-aromatics | 17.9 | 26.3 |
| Di-aromatics | 37.2 | 37.8 |
| Tri-aromatics | 10.1 | 9.1 |
| Tetra-aromatics | 8.3 | 5.5 |
| Pento-aromatics | 1.3 | 1.1 |
| Sulfur compounds | | |
| Benzothiophene | 10.2 | 8.3 |
| Dibenzothiophene | 10.4 | 6.2 |
| Naphthobenzothiophene | 4.6 | 3.3 |
| Other | 0.2 | 2.4 |
| Ratio, Diaromatics/Benzothiophene | 3.65 | 4.55 |

A control run A presented in Table I was made with the identified HVGO alone (no methanol present) in the same manner identified above with Run B. An analysis of the comparative data obtained with the REY catalyst show the following improvements associated with the use of methanol as a low molecular weight hydrogen donor when intimately mixed with and cracked with HVGO in a riser fluid catalyst cracking operation.

1. Much higher levels of aromatics + olefins in the gasoline (aromatics and olefins are the major contributors to octane number in gasoline).
2. Higher octane (89.5 R+O with $CH_3OH$ vs 87.8 R+O without $CH_3OH$).
3. Lower percent sulfur in fuel oil (4.24 wt.% with $CH_3OH$ vs 4.45 wt.% without $CH_3OH$).
4. Higher percent hydrogen in fuel oil (9.18 wt.% with $CH_3OH$ vs 8.21 wt.% without $CH_3OH$).
5. Higher naphthene/aromatic ratios in fuel oil 0.10 with methanol vs 0.08 without methanol).
6. Higher ratios of Diaromatics/Benzothiophenes (4.55 with $CH_3OH$, 3.65 without $CH_3OH$); this indicates that increased desulfurization occurs with methanol.

Example 2

In this example, the heavy vacuum gas oil identified in Example 1 was cracked with and without the presence of methanol with a catalyst mixture comprising a 2% REY crystalline zeolite in combination with a 10% ZSM-5 crystalline zeolite and supporting matrix (silica-clay). The method of operation was carried out similarly to that identified with respect to Example 1. Table II-A below provides the reaction conditions and mass balance obtained for Runs C (no methanol) and Run D (with methanol). Table II-B provides the gasoline inspection data for runs C and D and Table II-C provides the cycle oil inspection data for these two runs.

Table II-A

| REACTION CONDITIONS AND MASS BALANCE | Run C | Run D |
|---|---|---|
| OPERATING CONDITIONS | | |
| Reactor Inlet Temp., ° F. | 900 | 900 |
| Oil Temp., ° F. | 500 | 500 |
| Catalyst Inlet Temp.,° F. | 1110 | 1102 |
| Catalyst/Oil (Wt/Wt) Ratio | 6.68 | 6.81[a] |
| Catalyst Residence Time, Sec. | 4.70 | 6.11 |
| Reactor Pressure, Inlet, psig | 30 | 30 |
| Carbon, Spent Catalyst, %Wt | .285 | .342 |

Table II-A-continued

| REACTION CONDITIONS AND MASS BALANCE | Run C | Run D |
|---|---|---|
| Sulfur, Spent Catalyst, %Wt | .0091 | .0006 |
| Slip Ratio | 1.24 | 1.24 |
| Catalyst | ← 2% REY +10% ZSM-5 → | |
| YIELDS (NLB ON TOTAL FEED) | | |
| Conversion, % Vol[a] | 44.16 | 42.66[b] |
| $C_5$+ Gasoline, % Vol. | 33.12 | 35.15 |
| Total $C_4$, % Vol | 12.04 | 6.59 |
| Dry Gas, % Wt | 5.47 | 5.29 |
| Coke, % Wt | 2.08 | 2.83 |
| Gaso. Efficiency, % Vol | 75.0 | 82.39 |
| Gasoline R+O, Raw Octane No. | — | — |
| $H_2$ Factor | 99 | 25 |
| Recovery, % Wt. | 94.9 | 95.10 |
| [a]356° F at 90% cut point [a]on $CH_3OH$ + HVGO [b]based on HVGO only | | |
| Wt.% $CH_3OH$, % of Heavy-72-D-611 Vacuum Gas Oil | — | — |
| Molar Ratio, $CH_3OH$/HVGO | — | ~2.1 |
| Detailed Mass Balance | | |
| $H_2S$, % Wt. | .19 | .09 |
| $H_2$, % Wt. | .06 | .06 |
| $C_1$, % Wt. | .19 | 1.68 |
| $C_2$=, % Wt. | .20 | .33 |
| $C_2$, % Wt. | .22 | .36 |
| $C_3$=, % Vol. | 7.47 | 4.60 |
| $C_3$, % Vol. | .80 | .34 |
| $C_4$=, % Vol. | 8.13 | 5.00 |
| i-$C_4$, % Vol. | 3.34 | 1.13 |
| n-$C_4$, % Vol. | .57 | .46 |
| $C_5$=, % Vol. | 5.82 | 3.98 |
| i-$C_5$, % Vol. | 2.45 | 1.05 |
| n-$C_5$, % Vol. | .51 | .23 |
| $C_5$+ Gaso., % Vol. | 33.12 | 35.15 |
| Cycle Oil, % Vol. | 55.84 | 57.34 |
| Coke, % Wt. | 2.08 | 2.83 |
| Gaso./coke(wt/wt) Ratio | 12.82 | 10.14 |
| Gaso./gas | 4.87 | 5.43 |

Table II-B

| GASOLINE INSPECTIONS | Run C | Run D |
|---|---|---|
| Sp. Grav., 60° F. | .7487 | .7620 |
| API Grav., 60° F. | 57.5 | 54.2 |
| Alkylate, % Vol. | 26.05 | 16.03 |
| $C_5$ + Gaso. + Alky.,% Vol. | 59.17 | 51.19 |
| Outside i-$C_4$ Required, % Vol. | 14.26 | 9.69 |
| R+O Octane No, Raw | | |
| Hydrocarbon Type, $C_5$-Free, Vol.% | | |
| Paraffins | 23.6 | 10.4 |
| Olefins | 32.4 | 57.3 |
| Naphthenes | 18.1 | 5.9 |
| Aromatics | 25.7 | 26.4 |
| Distillation, ° F. | | |
| 10% | — | — |
| 50% | — | — |
| 90% | — | — |

Table II-C

| CYCLE OIL INSPECTIONS | Run C | Run D |
|---|---|---|
| Sp. Grav., 60° F. | .9701 | .9580 |
| API Gravity, 60° F. | 14.4 | 16.2 |
| Sulfur, % Wt. | 4.04 | 3.39 |

Table II-C-continued

| CYCLE OIL INSPECTIONS | Run C | Run D |
|---|---|---|
| Hydrogen, % wt. | 10.13 | 10.64 |
| Hydrocarbon Type, Wt.% | | |
| Paraffins | 15.7 | 16 |
| Mono-naphthenes | 6.9 | 7.8 |
| Poly-naphthenes | 9.2 | 10.1 |
| Aromatics | 68.3 | 66.2 |
| Naphthene/Aromatic (Wt/Wt) Ratio | .23 | .27 |
| Distillation, ° F. | | |
| 10% | 536 | 518 |
| 50% | 791 | 756 |
| 90% | 921 | 900 |
| Aromatic Breakdown, Normalized, Wt.% | | |
| Mono-aromatics | 23.4 | 34.2 |
| Di-aromatics | 29.0 | 32.1 |
| Tri-aromatics | 11.0 | 10.0 |
| Tetra-aromatics | 8.9 | 5.5 |
| Penta-aromatics | 1.9 | .9 |
| Sulfur Compounds | | |
| Benzothiophenes | 8.7 | 6.7 |
| Dibenzothiophenes | 8.3 | 5.6 |
| Naphthobenzothiophenes | 5.3 | 2.0 |
| Other | 3.8 | 2.9 |
| Ratio, Diaromatics/Benzothiophene | 3.33 | 4.79 |

It will be observed from Table II-A above that the conversion of the heavy gas oil feed with methanol produced significantly higher yields of $C_5$+ gasoline at a slightly lower conversion level than occurred in the control Run A for comparative purposes. Furthermore, the yield of $C_4$'s was lower, and the gasoline efficiency was much higher with methanol in the feed. An examination of the mass balance yields shows the methanol operation to be associated with higher gasoline and fuel oil yields at the expense of $C_4$ and lower boiling hydrocarbons. Also from the gasoline product inspection Table II-B, it is evident that the gasoline product of the methanol operation will be of a higher octane rating than the gasoline product of Run C, because of increased yields of olefins and aromatics. On the other hand, the cycle oil inspection data of Table II-C, shows lower sulfur compounds in the product of Run C (with methanol); a higher hydrogen content, a higher naphthene to aromatic ratio; less polycyclics and higher aromatics and a higher ratio of diaromatics/benzothiophene indicating that hydrogen transfer has occurred thus producing a better fuel.

Example 3

In this example, the heavy vacuum gas oil identified in Example 1 was converted in the presence of methylal which is a methyl ether of formaldehyde: $(CH_3O)_2CH_2$. The catalyst employed was a mixture comprising 2% REY crystalline zeolite in combination with 10% ZSM-5 type of crystalline zeolite supported by a silica-clay matrix. The method of operation was performed in the same manner identified in Example 1 at the operating conditions provided in Table III below. In the table comparative runs are shown with no promoter Run C and methanol promoter Run D.

TABLE III-A

COMPARISON OF REACTING HVGO WITH METHYLAL AND WITH/ WITHOUT METHANOL REACTION CONDITIONS AND MASS BALANCE

| | Run C[d] | Run E[b] | Run D |
|---|---|---|---|
| OPERATING CONDITIONS | | | |
| Reactor Inlet Temp., ° F. | 900 | 900 | 900 |
| Oil Temp., ° F. | 500 | 500 | 500 |
| Catalyst Inlet Temp., ° F. | 1110 | 1102 | 1102 |
| Catalyst/Oil (Wt/Wt) Ratio | 6.68 | 6.72[b] | 6.81[e] |
| Catalyst Residence Time, Sec. | 4.70 | 6.02 | 6.11 |
| Reactor Pressure, Inlet, psig | 30 | 30 | 30 |
| Carbon, Spent Catalyst, %Wt. | .285 | .601 | .342 |
| Sulfur, Spent Catalyst, %Wt. | .0091 | .0145 | .0006 |
| Slip Ratio | 1.24 | 1.28 | 1.24 |
| Catalyst | 2% REY + 10% ZSM-5 | | |
| YIELDS(NLB ON TOTAL FEED)[f] | | | |
| Conversion, % Vol[a] | 44.16 | 42.15 | 42.66 |
| $C_5$+ Gasoline, % Vol. | 33.12 | 31.51 | 35.15 |
| Total $C_4$, % Vol. | 12.04 | 6.46 | 6.59 |
| Dry Gas, % Wt. | 5.47 | 5.78 | 5.29 |
| Coke, % Wt. | 2.08 | 4.90 | 2.83 |
| Gaso. Efficiency, % Vol. | 75.0 | 74.8 | 82.39 |
| Gasoline R+O, Raw Octane No. | — | — | — |
| $H_2$ Factor | 99 | 18 | 25 |
| Recovery, % Wt. | 94.9 | 98.1 | 95.10 |
| Wt.% Promoter % of HVGO | 0 | 16.0 | 16.0 |
| Molar Ratio, Promoter/HVGO | 0 | 0.85 | 2.1 |
| Detailed Mass Balance | | | |
| $H_2S$, % Wt. | .19 | 0.1 | .09 |
| $H_2$, % Wt. | .06 | .05 | .06 |
| $C_1$, % Wt. | .19 | 1.89 | 1.68 |
| $C_2$=, % Wt. | .20 | .35 | .33 |
| $C_2$, % Wt. | .22 | .42 | .36 |
| $C_3$=, % Vol. | 7.47 | 4.04 | 4.60 |
| $C_3$, % Vol. | .80 | 1.28 | .34 |
| $C_4$=, % Vol. | 8.13 | 4.83 | 5.00 |
| i-$C_4$, % Vol. | 3.34 | 1.27 | 1.13 |
| n-$C_4$, % Vol. | .57 | .36 | .46 |
| $C_5$=, % Vol. | 5.82 | 3.88 | 3.98 |
| i-$C_5$, % Vol. | 2.54 | 1.34 | 1.05 |
| n-$C_5$, % Vol. | .51 | .22 | .23 |
| $C_5$+ Gaso., % Vol. | 33.12 | 31.51 | 35.15 |
| Cycle Oil, % Vol. | 55.84 | 57.86 | 57.34 |
| Coke, % Wt. | 2.08 | 4.90 | 2.83 |

[a]356° F. at 90% cut point
[b]Methylal = methyl ether of formaldehyde
[d]Control Run - no promoter
[e]On promoter + HVGO (heavy vacuum gas oil)
[f]On HVGO feed only

TABLE III-B

| GASOLINE INSPECTIONS | Run C | Run E | Run D |
|---|---|---|---|
| Sp. Grav., 60° F. | .7487 | .7580 | .7620 |
| API Grav., 60° F. | 57.5 | 55.18 | 54.2 |
| Alkylate, % Vol. | 26.05 | 14.84 | 16.03 |
| $C_5$ + Gaso. + Alky., % Vol | 59.17 | 46.35 | 51.19 |
| Outside i-$C_4$ Required, % Vol. | 14.26 | 8.72 | 9.69 |
| R+O Octane No., Raw | — | — | — |
| Hydrocarbon Type, $C_5$-Free Vol. % | | | |
| Paraffins | 23.6 | 11.8 | 10.4 |
| Olefins | 32.4 | 49.9 | 57.3 |
| Naphthenes | 18.1 | 6.3 | 5.9 |
| Aromatics | 25.7 | 32.0 | 26.4 |
| Distillation, ° F. | | | |
| 10% | — | — | — |
| 50% | — | — | — |
| 90% | — | — | — |

TABLE III-C

CYCLE OIL INSPECTIONS

| | Run C | Run E | Run D |
|---|---|---|---|
| Sp. Grav., 60° F. | .9701 | .9594 | .9580 |
| API Gravity, 60° F. | 14.4 | 16.0 | 16.2 |
| Sulfur, % Wt. | 4.04 | 3.306 | 3.39 |
| Hydrogen, % Wt. | 10.13 | 10.57 | 10.64 |
| Hydrocarbon Type, Wt.% | | | |
| Paraffins | 15.7 | 15.5 | 16 |
| Mono-naphthenes | 6.9 | 7.6 | 7.8 |
| Poly-naphthenes | 9.2 | 9.7 | 10.1 |
| Aromatics | 68.3 | 67.3 | 66.2 |
| Naphthene/Aromatic (Wt/Wt) Ratio | .23 | 0.26 | .27 |
| Distillation, ° F. | | | |
| 10% | 536 | 523 | 518 |
| 50% | 791 | 749 | 756 |
| 90% | 921 | 903 | 900 |
| Aromatic Breakdown, Normalized, Wt.% | | | |
| Mono-aromatics | 23.4 | 29.2 | 34.2 |
| Di-aromatics | 29.0 | 32.2 | 32.1 |
| Tri-aromatics | 11.0 | 11.1 | 10.0 |
| Tetra-aromatics | 8.9 | 6.0 | 5.5 |
| Penta-aromatics | 1.9 | 1.2 | 0.9 |
| Sulfur Compounds | | | |
| Benzothiophenes 8.7 | 6.9 | 6.7 | |
| Dibenzotiophenes | 8.3 | 5.6 | 5.6 |
| Naphthobenzothiophenes | 5.3 | 3.1 | 2.0 |
| Other | 3.8 | 4.6 | 2.9 |
| Ratio, Diaromatics/Benzothiophene | 3.33 | 4.67 | 4.79 |

It will be observed upon examination of the data of Table III that a significant improvement in gasoline quality and cycle oil quality is obtained with either methylal or methanol as a promoter. The gasoline product is shown to have much lower paraffins, much higher olefins and much higher aromatics than obtained by Run C with no promoter. Therefore the gasoline product obtained with the promoter is of a higher octane.

The cycle oil product inspection shows lower sulfur and higher hydrogen in the product of Runs E and D using methylal and methanol as a promoter. In addition there is a higher naphthene/aromatic ratio, lower amounts of the higher molecular weight polyaromatics, more monoaromatics, higher ratio of diaromatics to benzothiophenes — all of which indicate a better quality of fuel oil.

Having thus provided a general discussion of the method and process of the present invention and described specific examples in support thereof, it is to be understood that no undue restrictions are to be imposed by reason thereof except as defined by the following claims.

We claim:

1. A method for cracking high boiling hydrocarbons to products including gasoline which comprises passing a hydrocarbon feed material higher boiling than gasoline in admixture with a gasiform material comprising non-hydrocarbon materials contributing non-molecular mobile hydrogen and/or carbon-hydrogen fragments at the reaction conditions employed in contact with a combination of crystalline zeolite cracking materials providing a pore size within the range of 4 to 15 Angstrom units, maintaining reaction conditions including a pressure below 100 psig and a cracking temperature within the range of 400° to 1200° F to effect reaction between formed mobile hydrogen fragments and/or carbon-hydrogen fragments with products of cracking said high boiling hydrocarbon feed and recovering products of said cracking operation contributing to the formation of and forming gasoline boiling range products.

2. The method of claim 1 wherein the high boiling hydrocarbon material and the gasiform material are intimately mixed with one another and reacted in the presence of said crystalline zeolite catalyst under conditions to effect cracking and additive carbon-hydrogen reactions to occur and produce products of a quality improved over those formed in the absence of said added gasiform material.

3. The method of claim 1 wherein the gasiform material comprises $C_1$ to $C_5$ carbon materials.

4. The method of claim 1 wherein the gasiform material comprises refinery product gaseous material.

5. The method of claim 1 wherein the crystalline zeolite catalytic material is selected from the group consisting of X and Y faujasite crystalline zeolites, mordenite, crystalline zeolites of a class represented by ZSM-5 crystalline zeolite and crystalline zeolites represented by offretite and erionite.

6. The method of claim 5 wherein the crystalline zeolite catalytic material is dispersed in an inorganic oxide containing matrix material.

7. The method of claim 6 wherein the catalytic material is provided with a hydrogen activating function.

8. The method of claim 1 wherein the mobile hydrogen is obtained from a mixture of light paraffins or olefins in combination with a component selected from the group consisting of $C_1$ to $c_5$ alcohols, aliphatic ethers, acetals, aldehydes and ketones.

9. The methodof claim 1 wherein the crystalline zeolite catalytic material is dispersed in an active inorganic oxide combined with clay modified by calcination, acid or alkali medium treatment and combinations thereof.

10. The method of claim 1 wherein the crystalline zeolite catalytic material is provided with a metal component known to promote the Fischer-Tropsch reaction.

11. The method of claim 1 wherein the gasiform material comprises material selected from the group consisting of light gas fractions, light olefins and low boiling liquid material.

12. The method of claim 1 wherein the elevated temperature of the cracking operation is selected from within the range of 800° F up to about 1100° F.

13. The method of claim 1 wherein the gasiform material comprises methanol and the ratio of methanol to hydrocarbon charge in the cracking operation is selected from within the range of 0.01 to about 5 on a weight basis.

14. The method of claim 1 wherein the high boiling hydrocarbon feed is selected from a group of hydrocarbons consisting of atmospheric gas oil, vacuum gas oils, atmospheric and vacuum resids, synthetic crudes derived from oil shale, tar sands, coal and combinations thereof.

* * * * *